US007513584B2

(12) United States Patent
Kuwahara et al.

(10) Patent No.: US 7,513,584 B2
(45) Date of Patent: Apr. 7, 2009

(54) PRINTING DEVICE AND PRINTING METHOD

(75) Inventors: Soichi Kuwahara, Kanagawa (JP); Iwao Ushinohama, Kanagawa (JP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/534,177

(22) PCT Filed: Nov. 12, 2003

(86) PCT No.: PCT/JP03/14372

§ 371 (c)(1),
(2), (4) Date: Feb. 7, 2006

(87) PCT Pub. No.: WO2004/043701

PCT Pub. Date: May 27, 2004

(65) Prior Publication Data

US 2006/0203016 A1 Sep. 14, 2006

(30) Foreign Application Priority Data

Nov. 13, 2002 (JP) ..... 2002-329854

(51) Int. Cl.
*B41J 29/38* (2006.01)

(52) U.S. Cl. ..... 347/5; 347/10; 347/40; 347/54; 347/55; 347/77; 358/1.8; 358/521

(58) Field of Classification Search ..... None
See application file for complete search history.

(56) References Cited

U.S. PATENT DOCUMENTS 4,973,499 A * 11/1990 Iwata et al. ..... 427/261
6,371,588 B1 * 4/2002 Tsuruoka ..... 347/12

(Continued)

FOREIGN PATENT DOCUMENTS

JP 11-207963 8/1999

(Continued)

OTHER PUBLICATIONS

Machine Language Translation of JP 2004-306417 A. http://www4.ipdl.inpit.go.jp/Tokujitu/tjsogodbenk.ipdl Aug. 9, 2007.*

*Primary Examiner*—Luu Matthew
*Assistant Examiner*—John P Zimmermann
(74) *Attorney, Agent, or Firm*—Sonnenschein Nath & Rosenthal LLP

(57) ABSTRACT

A printing apparatus includes a head having a plurality of ink discharging portions provided in a juxtaposed linear relationship. A discharging direction of an ink droplet to be discharged from each ink discharging portion can be deflected in a plurality of directions. A printing resolution is determined in response to print data from among a plurality of printing resolutions, and the ink discharging portion from which an ink droplet is to be discharged are selected based on the determined printing resolution. Further, the discharging direction of an ink droplet of each selected ink discharging portion is determined, and a discharge execution signal with which the discharging direction is specified is transmitted to the selected ink discharging portion so that printing is executed with the printing resolution determined in response to the print data from among the plurality of printing resolutions.

6 Claims, 11 Drawing Sheets

U.S. PATENT DOCUMENTS

| | | | | |
|---|---|---|---|---|
| 6,402,292 | B1 * | 6/2002 | Ninomiya | 347/35 |
| 6,527,375 | B2 * | 3/2003 | Kobayashi et al. | 347/55 |
| 6,536,873 | B1 * | 3/2003 | Lee et al. | 347/54 |
| 2003/0030824 | A1 * | 2/2003 | Ogasahara et al. | 358/1.8 |
| 2003/0058289 | A1 * | 3/2003 | Yamada et al. | 347/12 |
| 2003/0179264 | A1 * | 9/2003 | Yamada et al. | 347/48 |
| 2003/0202053 | A1 * | 10/2003 | Hawkins et al. | 347/77 |
| 2003/0234836 | A1 * | 12/2003 | Tang et al. | 347/78 |

FOREIGN PATENT DOCUMENTS

| | | | |
|---|---|---|---|
| JP | 2000-263875 | | 9/2000 |
| JP | 2004306417 | A * | 11/2004 |

* cited by examiner

600dpi

720dpi

PRINTING DEVICE AND PRINTING METHOD

TECHNICAL FIELD

This invention relates to a printing apparatus which includes a head having a plurality of ink discharging portions provided in a juxtaposed relationship thereon and a printing method which uses a head having a plurality of ink discharging portions provided in a juxtaposed relationship thereon, and particularly relates to a technique for printing print data with an optimum printing resolution.

BACKGROUND ART

An ink jet printer (hereinafter referred to simply as "printer") which is an example of a related-art printing apparatus includes a head having a plurality of ink discharging portions provided in a juxtaposed relationship thereon and each having a nozzle. Ink droplets are discharged from the ink discharging portions toward a printing object to form an image.

Here, the printing resolution of the head depends upon the juxtaposition distance of the ink discharging portions. For example, where the resolution is 300 dpi, the distance between the ink discharging portions is set to approximately 84.6 μm.

In addition to a case wherein a head of 300 dpi is used, for example, to print with a resolution of 300 dpi, also it is possible to print with another resolution equal to 1/n (n is a positive number) the original resolution of the head such as 150 dpi by thinning out the discharges of ink droplets from the ink discharging portions.

Or, if the head is moved by a plural number of times at the same printing position so that ink droplets are landed at distances equal to 1/n the distance between the ink discharging portions, then also it is possible to print with a resolution equal to n times the original resolution of the head such as, for example, 600 dpi or 1,200 dpi.

However, in the related-art described above, where the resolutions of print data and the printer do not coincide with each other, it is necessary to convert the print data into print data of the resolution of the printer by interpolation. However, the related-art described above has a problem that the conversion deteriorates the resolution.

FIG. 11A shows, in an enlarged scale, an image of 600 dpi and particularly shows white and black lines formed in a pitch of 42.3 μm. If it is tried to print the print data using a printer having a resolution of, for example, 720 dpi, then the image of 600 dpi is converted into another image of 720 dpi. However, upon such conversion, the resolution of the image deteriorates, and an image having a deteriorated resolution as shown in FIG. 11B is printed.

Further, in a printer which includes a serial head which successively discharges ink droplets while the head is moved in a widthwise direction of print paper, also it is possible to change the displacement amount of the head in the paper feeding direction to vary the resolution. However, the printer has a problem that, depending upon a required resolution, a very small displacement amount is required and a very long period of time is required for the printing. Further, a printer which includes a line head having ink discharging portions provided in a juxtaposed relationship over a substantially overall width of print paper has a problem that the resolution cannot be changed because ink droplets are merely discharged from ink discharging portions of the fixedly provided line head but the line head does not move in the widthwise direction of the print paper.

DISCLOSURE OF INVENTION

Accordingly, the subject to be solved by the present invention is to make use of a technique (Japanese Patent Application No. 2002-112947 and so forth) proposed already by the applicant of the present patent application wherein an ink droplet from each of ink discharging portions can be deflected to a plurality of directions to make it possible to vary the resolution to print and to control, when the resolution is varied, so that the deterioration of the image may be reduced. A high effect is obtained particularly by a printer which includes a line head having ink discharging portions provided in a juxtaposed relationship over a substantially overall width of the print paper.

The present invention solves the subject described above by the following solving means.

A printing apparatus comprising a head including a plurality of ink discharging portions provided in a juxtaposed relationship thereon and capable of deflecting a discharging direction of an ink droplet to be discharged from each of said ink discharging portions to a plurality of directions in the juxtaposition direction of said ink discharging portions and further capable of setting the discharging deflection angle which is a maximum deflection amount of an ink droplet to be discharged from said ink discharging portions to a plurality of angles, wherein:

a printing resolution is determined in response to inputted print data from between or among a plurality of printing resolutions which are determined from a juxtaposition distance of said ink discharging portions, the discharging deflection angle of an ink droplet to be discharged from said ink discharging portions and a plurality of directions in which an ink droplet can be discharged from said ink discharging portions; and those of said ink discharging portions from which an ink droplet is to be discharged and the discharging deflection angle of an ink droplet to be discharged from said ink discharging portions are selected based on the determined printing resolution and the discharging direction of one or two or more ink droplets from the selected ink discharging portions on one line is determined; and a discharge execution signal with which the discharging direction of an ink droplet can be specified is transmitted to each of the selected ink discharging portions to execute printing with the printing resolution determined in response to the inputted print data from between or among the plurality of printing resolutions.

In the invention described above, the head of the printing apparatus is formed such that the discharging direction of an ink droplet can be deflected to a plurality of directions in the juxtaposition direction of the ink discharging portions.

If print data are inputted to the printing apparatus, then an optimum printing resolution is determined in response to the print data. Then, after the printing resolution is determined, those of the ink discharging portions from which an ink droplet is to be discharged are selected, and a discharge execution signal with which the discharging direction of an ink droplet can be specified is transmitted to each of the selected ink discharging portions. The ink discharging portion discharges an ink droplet to a predetermined direction in accordance with the discharge execution signal. Accordingly, printing can be performed with a printing resolution optimum to the print data.

BEST MODE FOR CARRYING OUT THE INVENTION

In the following, an embodiment of the present invention is described with reference to the drawings and so forth.

Figure 1:
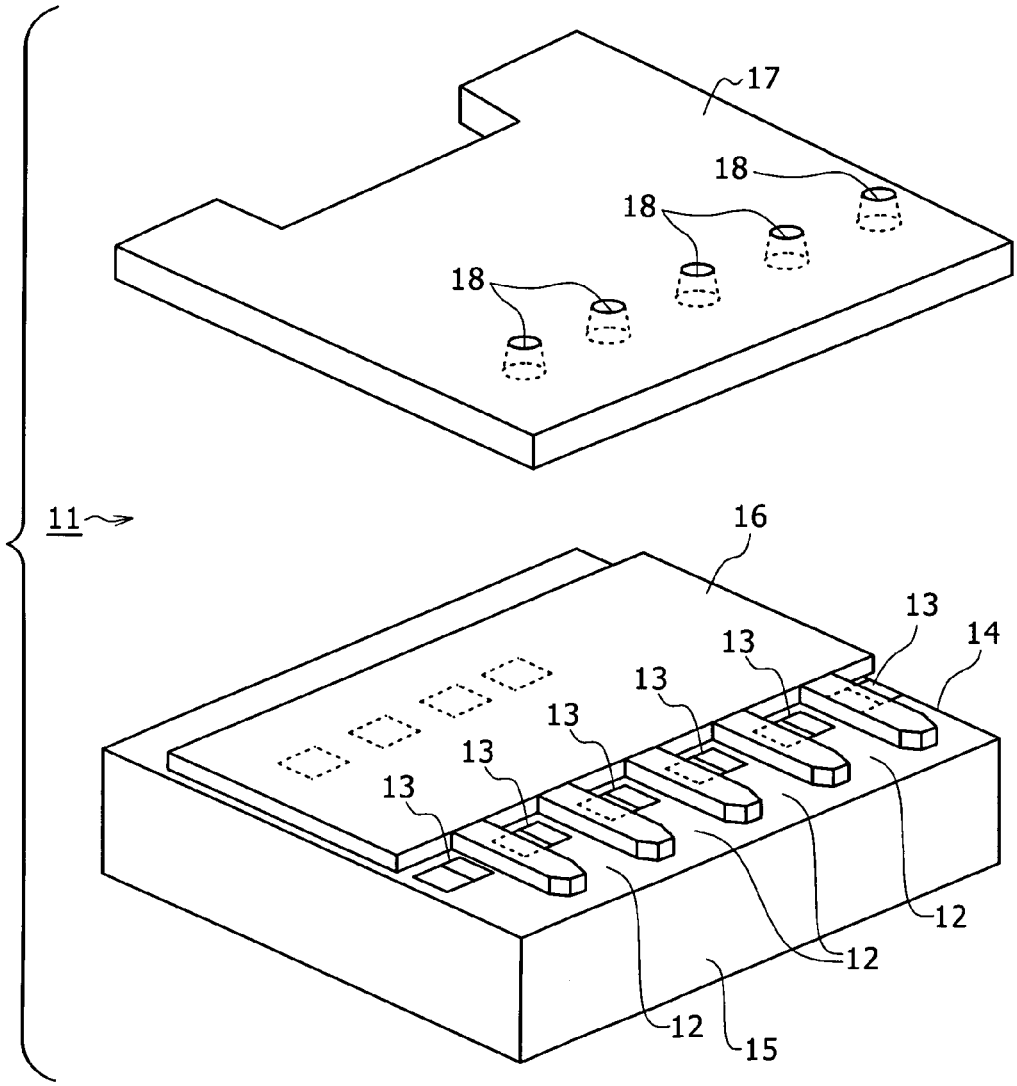
FIG. 1 is an exploded perspective view showing a head of an ink jet printer to which an ink printing apparatus according to the present invention is applied.

FIG. 1 is an exploded perspective view showing a head 11 of an ink jet printer (hereinafter referred to simply as "printer") of the thermal type to which a printing apparatus according to the present invention is applied. Referring to FIG. 1, a nozzle sheet 17 is adhered to a barrier layer 16 and shown in an exploded state.

In the head 11, a substrate member 14 includes a semiconductor substrate 15 made of silicon or the like, and heat generating resistor members 13 (energy generation means) formed by deposition on one of faces of the semiconductor substrate 15. The heat generating resistor members 13 are electrically connected to a circuit hereinafter described through a conductor section (not shown) formed on the semiconductor substrate 15.

The barrier layer 16 is made of a dry film resist, for example, of the photo-curing type and is formed by laminating the dry film resist over an overall face of the semiconductor substrate 15 on which the heat generating resistor members 13 are formed and then removing unnecessary portions by a photo-lithography process.

Further, the nozzle sheet 17 has a plurality of nozzles 18 formed therein and is formed, for example, by electrocasting of nickel. The nozzle sheet 17 is adhered to the barrier layer 16 such that the positions of the nozzles 18 may coincide with the positions of the heat generating resistor members 13, that is, the nozzles 18 may oppose to the heat generating resistor members 13.

Ink liquid chambers 12 are formed from the substrate member 14, barrier layer 16 and nozzle sheet 17 in such a manner as to surround the heat generating resistor members 13. In particular, the substrate member 14 forms a bottom wall of the ink liquid chambers 12 in the figure; the barrier layer 16 forms side walls of the ink liquid chambers 12; and the nozzle sheet 17 forms a top wall of the ink liquid chambers 12. Consequently, each of the ink liquid chambers 12 has an opening face at a right side front face thereof in FIG. 1, and the opening face and an ink flow path (not shown) communicate with each other.

The one head 11 described above includes a plurality of heat generating resistor members 13 normally in a unit of 100 members and ink liquid chambers 12 which individually include the heat generating resistor members 13. The heat generating resistor members 13 can be selected uniquely in accordance with instructions from a control section of the printer so that ink in the ink liquid chambers 12 corresponding to the heat generating resistor members 13 is discharged from the nozzles 18 opposing to the ink liquid chambers 12.

In particular, ink is filled into the ink liquid chambers 12 from an ink tank (not shown) coupled to the head 11. Then, pulse current is supplied for a short period of time, for example, for 1 to 3 μsec, to any of the heat generating resistor members 13 to rapidly heat the heat generating resistor member 13. As a result, a vapor phase ink bubble is generated in the ink at a location contacting with the heat generating resistor member 13. As a result of expansion of the ink bubble, the ink of a predetermined volume is pushed away (the ink comes to the boil). Consequently, the ink of a volume substantially equal to that of the pushed away ink is discharged as a droplet from the corresponding nozzle 18 and landed on print paper.

It is to be noted that, in the present specification, a portion formed from an ink liquid chamber 12, a heat generating resistor member 13 disposed in the ink liquid chamber 12 and a nozzle 18 disposed above the heat generating resistor member 13 is referred to as "ink discharging portion". In other words, the head 11 includes a plurality of ink discharging portions provided in a juxtaposed relationship with each other.

Figure 2:
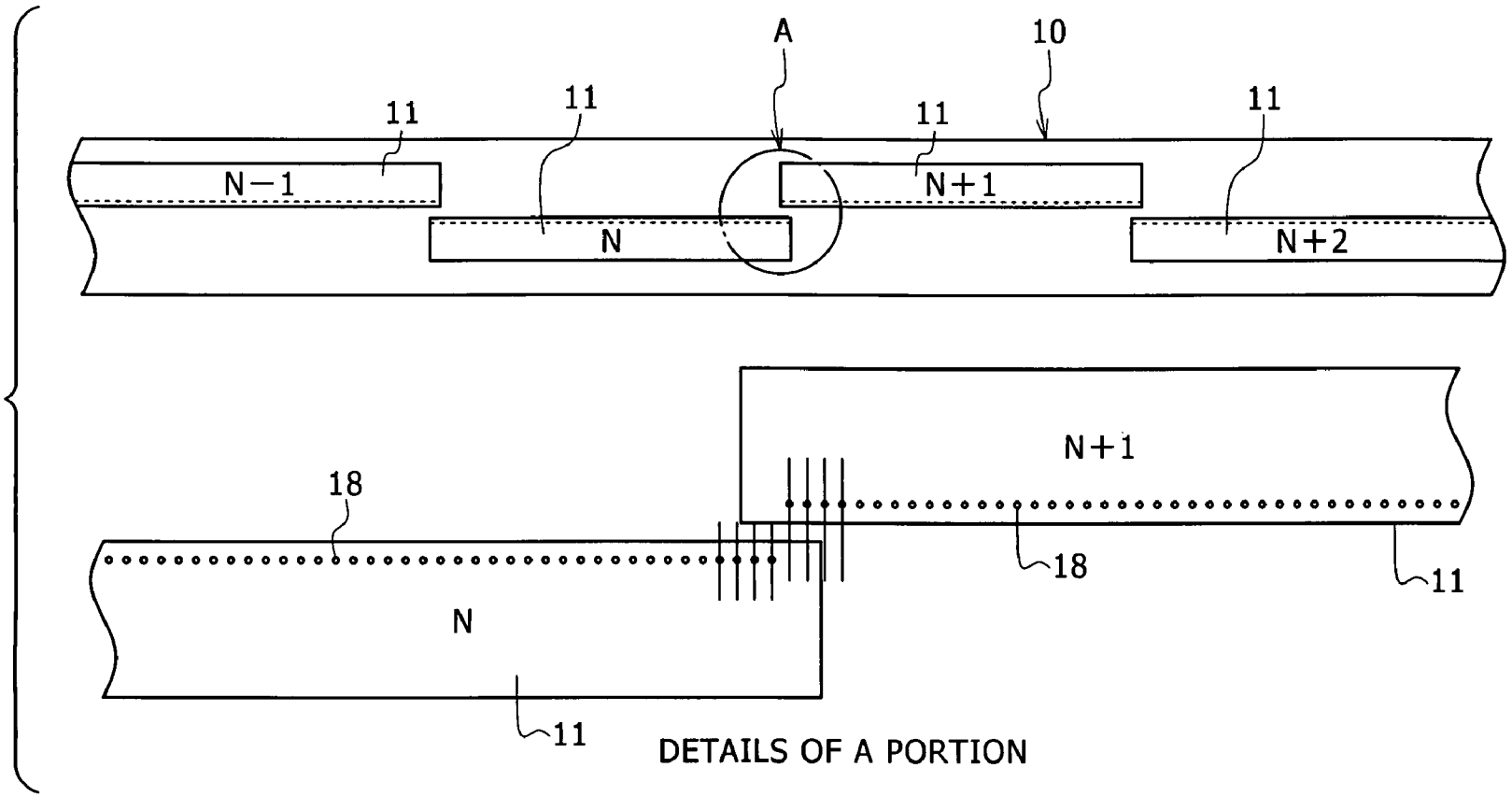
FIG. 2 is a plan view showing an embodiment of a line head.

Further, in the present embodiment, a plurality of heads 11 are disposed in a juxtaposed relationship in the widthwise direction of the print paper to form a line head. FIG. 2 is a plan view showing an embodiment of the line head 10. In FIG. 2, four heads 11 ("N−1", "N", "N+1" and "N+2") are shown. When the line head 10 is to be formed, a plurality of portions (head chips) each formed by removing the nozzle sheet 17 from the head 11 in FIG. 1 are juxtaposed. Then, a single nozzle sheet 17 having nozzles 18 formed at positions thereof corresponding to the ink discharging portions of all of the head chips is adhered to an upper portion of the head chips to form the line head 10. While the heads 11 adjacent to each other are arranged in one side and the other side, respectively across an ink flow path, the heads 11 on the one side oppose the heads 11 on the other side. i.e., the heads 11 are arranged so that the nozzles 18 oppose each other (a so-called staggered arrangement). That is, in FIG. 2, a portion sandwiched by a line connecting external peripheries, adjacent to the nozzles 18, of the (N−1)th head 11 and the (N+1)th head 11 together and a line connecting external peripheries, adjacent to the nozzles 18, of the Nth head 11 and the (N+2)th head 11 together is the ink flow path of this line head 10. Furthermore, the heads 11 are arranged so that the pitch between the nozzles 18 at ends of the heads 11 adjacent to each other, i.e., in detailed A portion of FIG. 2, the space between the nozzle 18 at the right most of the Nth head 11 and the nozzle 18 at the left most of the (N+1)th head 11, is substantially identical to the space between the nozzles 18 of the head 11.

Now, the ink discharging portions of the present embodiment are described in more detail.

Figure 3:
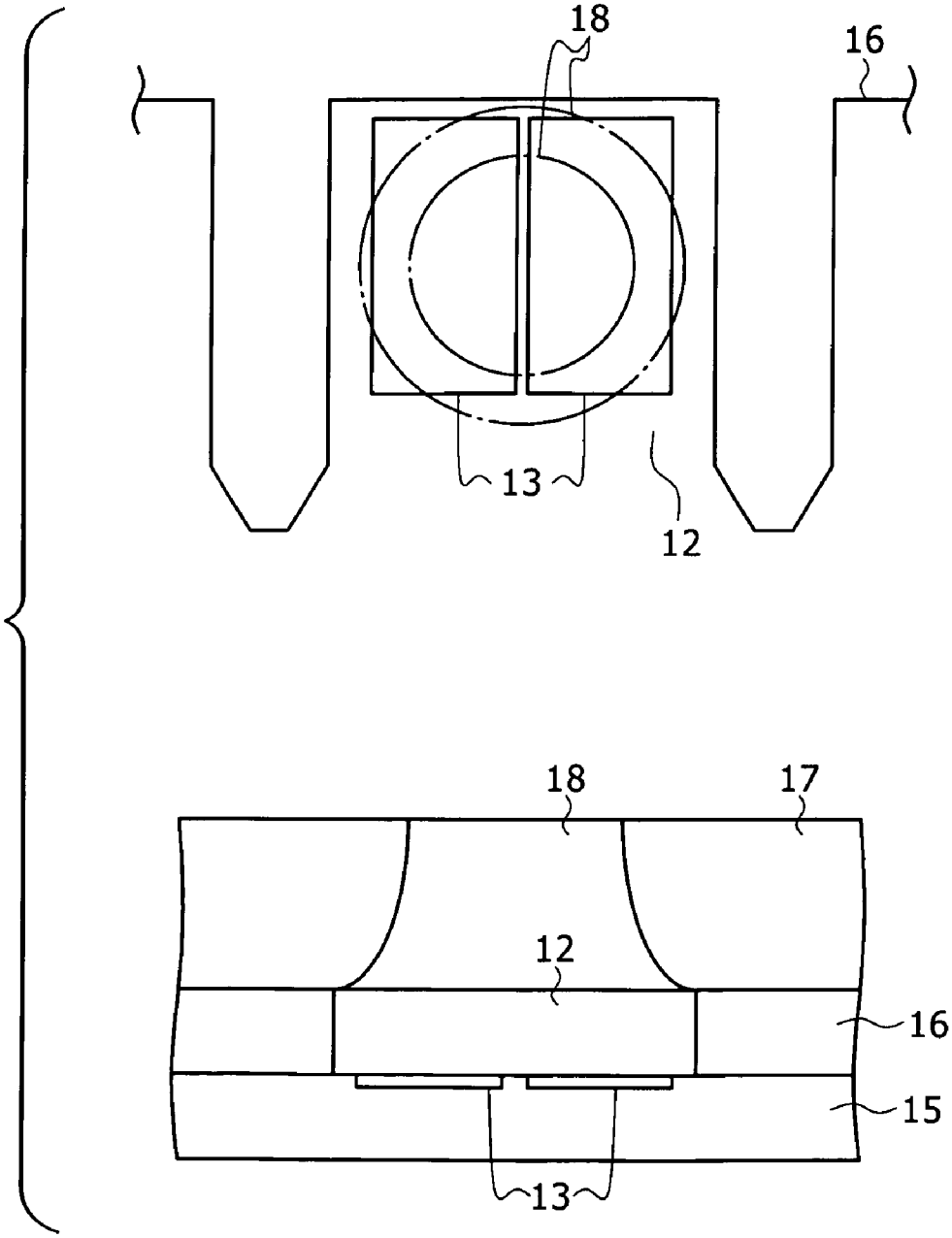
FIG. 3 is a plan view and a side elevational sectional view showing an ink discharging portion of the head more particularly.

FIG. 3 is a plan view and a side elevational sectional view showing an ink discharging portion of a head 11 more particularly. In the plan view of FIG. 3, a nozzle 18 is indicated by alternate long and short dashed lines.

As shown in FIG. 3, in the present embodiment, two divisional pieces of a heat generating resistor member 13 are provided in a juxtaposed relationship in one ink liquid chamber 12. Further, the juxtaposition direction of the two divisional pieces of the heat generating resistor member 13 is the juxtaposition direction (leftward and rightward direction in FIG. 3) of the nozzles 18 (ink discharging portions).

Where the heat generating resistor member 13 is of the type wherein it is divided into two divisional pieces in a vertical direction in this manner, since the heat generating resistor member 13 has an equal length but has a width reduced to one half, the heat generating resistor member 13 has a resistance value equal to twice. If the two divisional pieces of the heat generating resistor member 13 are connected in series, then the two pieces of the heat generating resistor member 13 each having the twice resistance value are connected in series and exhibits a resistance value equal to four times.

Here, in order for the ink in the ink liquid chamber 12 to be boiled, it is necessary to apply fixed electric power to the heat generating resistor member 13 to heat the heat generating resistor member 13. This is because an ink droplet is discharged by the energy when the ink is boiled. Then, while, where the resistance value is low, it is necessary to make the electric current to be supplied high, the ink can be boiled with lower electric current by raising the resistance value of the heat generating resistor member 13.

Consequently, also the size of a transistor and so forth for supplying electric current can be reduced, and reduction of the space can be anticipated. It is to be noted that, although the resistance value can be increased if the heat generating resistor member 13 is formed with a reduced thickness, there is a fixed limitation to reduction of the thickness of the heat generating resistor member 13 from the point of view of the material or the strength (durability) selected for the heat generating resistor member 13. Therefore, the resistance value of the heat generating resistor member 13 is raised by dividing the heat generating resistor member 13 without reducing the thickness.

Where a two-piece heat generating resistor member 13 is provided in one ink liquid chamber 12, if the times (bubble generation times) necessary for both pieces of the heat generating resistor member 13 to be heated to a temperature at which the ink is boiled are set equal to each other, then the ink is boiled at the same time on the two pieces of the heat generating resistor member 13 and an ink droplet is discharged in the direction of the center axis of the nozzle 18.

In contrast, if a time difference appears between the bubble generation times of the two pieces of the heat generating resistor member 13, then the ink is not boiled at the same time on the two pieces of the heat generating resistor member 13. Consequently, the discharging direction of the ink droplet is displaced from the direction of the center axis of the nozzles 18, and the ink droplet is discharged in a deflected direction. Consequently, the ink droplet is landed at a position different from the landing position of the ink droplet when it is discharged without any deflection.

Figure 4:
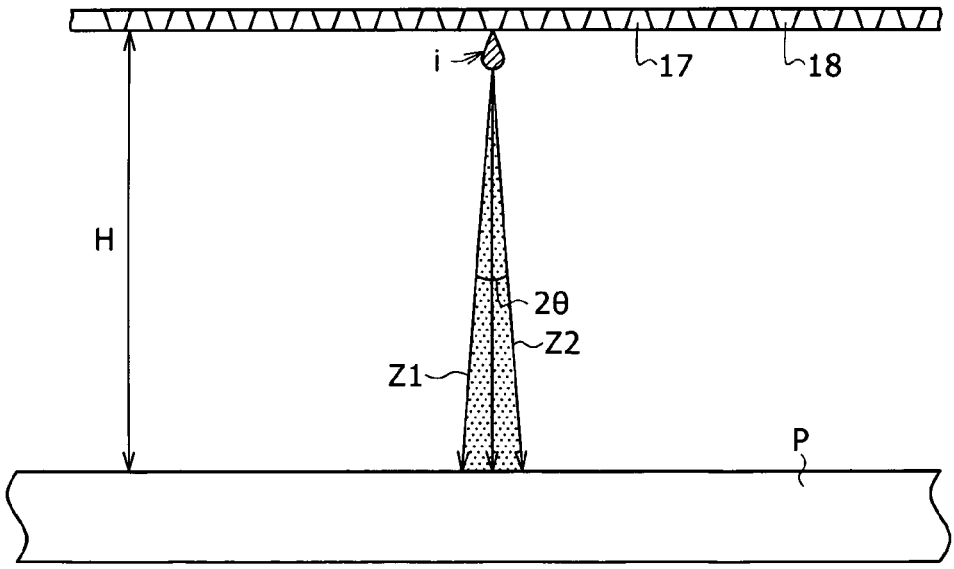
FIG. 4 is a view illustrating deflection of a discharging direction of an ink droplet.

FIG. 4 is a view illustrating deflection of the discharging direction of an ink droplet. Referring to FIG. 4, if an ink droplet i is discharged perpendicularly to a discharging plane of the ink droplet i, then the ink droplet i is discharged without deflection. In contrast, if the discharging direction of the ink droplet i is deflected and the discharging angle is displaced by θ from the perpendicular direction (Z1 or Z2 direction in FIG. 4), then where the distance between the discharging plane and the P plane of the print paper (landing plane of the ink droplet i) is represented by H (H is substantially fixed), the landing position of the ink droplet i is displaced by $$\Delta L = H \times \tan\theta$$

Figure 5A:
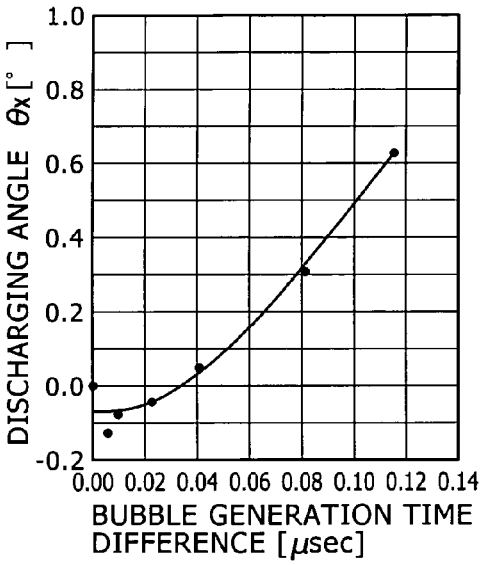
FIGS. 5A and 5B are graphs illustrating a relationship between the ink bubble generation time difference between two divisional pieces of a heat generating resistor member and the discharging angle of an ink droplet.
Figure 5B:
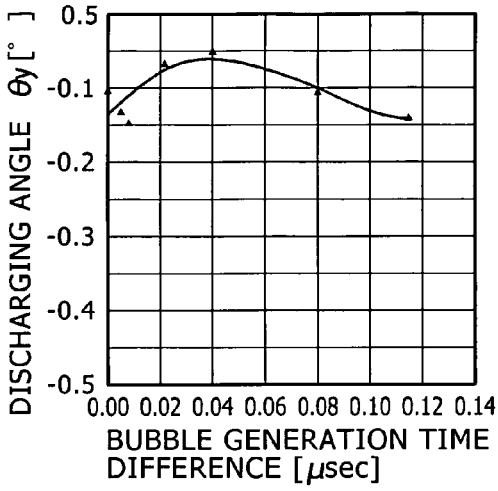
Figure 5C:
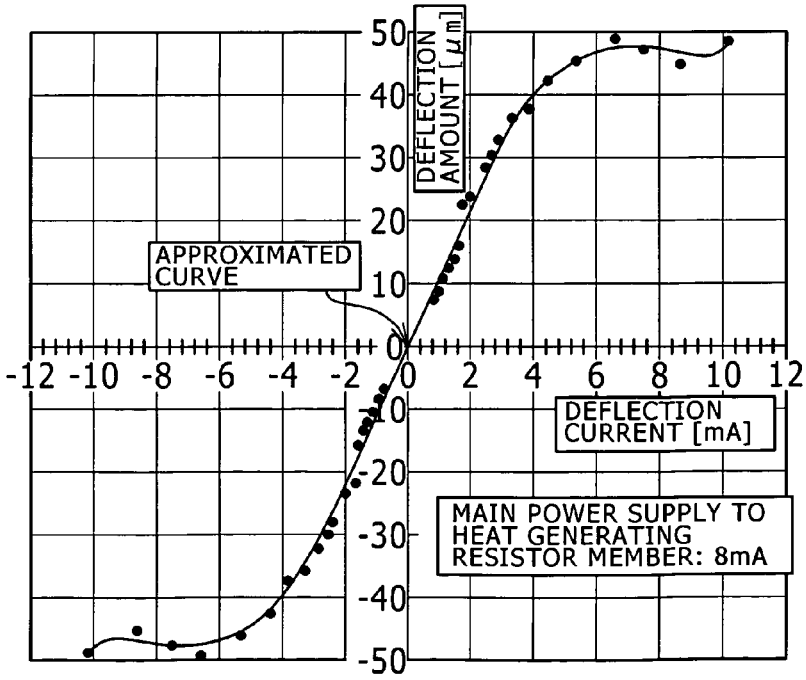
FIG. 5C is a graph illustrating actual measurement value data of the ink bubble generation time difference between the two divisional pieces of the heat generating resistor member.

FIGS. 5A and 5B are graphs illustrating a relationship between the ink bubble generation time difference between the two divisional pieces of the heat generating resistor member 13 and the discharging angle of an ink droplet and indicate a result of a simulation by a computer. In the graphs, the X direction is the juxtaposition direction of the nozzles 18, and the Y direction is a direction (print paper feeding direction) perpendicular to the X direction. Meanwhile, FIG. 5C illustrates actual measurement value data of the ink bubble generation time difference by the two divisional pieces of the heat generating resistor member 13. In FIG. 5C, the axis of abscissa indicates the deflection current which is one half the difference in electric current amount between the two divisional pieces of the heat generating resistor member 13, and the axis of ordinate indicates the displacement amount at the landing position of an ink droplet (the displacement amount was actually measured setting the distance between the discharging plane of an ink droplet to the landing position on the print paper to approximately 2 mm). In FIG. 5C, deflection discharging of an ink droplet was performed setting the main current of the heat generating resistor member 13 to 80 mA while the deflection current was applied in an overlapping relationship to one of the pieces of the heat generating resistor member 13.

Where bubble generations of the two divisional pieces of the heat generating resistor member 13 divided in the juxtaposition direction of the nozzles 18 have a time difference, the discharging angle of an ink droplet is displaced from the perpendicular, but the discharging angle θx of an ink droplet in the juxtaposition direction of the nozzles 18 increases as the bubble generation time difference increases.

Therefore, in the present embodiment, this characteristic is utilized such that two divisional pieces of the heat generating resistor member 13 are provided and the amounts of current to be supplied to the individual pieces of the heat generating resistor member 13 are made different from each other to control the bubble generation times on the two pieces of the heat generating resistor member 13 so that they may be different from each other thereby to deflect the discharging direction of an ink droplet (discharging direction deflection means).

For example, where the resistance values of the two divisional pieces of the heat generating resistor member 13 are not equal values to each other due to a production error or the like, a bubble generation time difference appears between the two pieces of the heat generating resistor member 13. Consequently, the discharging angle of an ink droplet is displaced from the perpendicular, and the landing position of an ink droplet is displaced from its original position. However, if the bubble generation times on the different pieces of the heat generating resistor member 13 are controlled so that the bubble generation times of the two pieces of the heat generating resistor member 13 may be the same time by making the current amounts to be supplied to the two divisional pieces of the heat generating resistor member 13, then it is possible to control the ink droplet discharging angle to the perpendicular.

For example, by deflecting the discharging directions of all ink droplets in a particular one, two or more ones of the heads 11 in the line head 10 with respect to their original directions, the discharging directions of the heads 11 from which ink droplets are not discharged in predetermined directions due to a production error or the like can be corrected so that ink droplets are discharged in the predetermined directions.

Further, it is possible to deflect only the discharging directions of ink droplets from one, two or more particular ink discharging portions in one head 11. For example, if the discharging direction of an ink droplet from a particular ink discharging portion in one head 11 is not parallel to the discharging directions of ink droplets from the other ink discharging portions, then it is possible to deflect the discharging direction of an ink droplet from the particular ink discharging portion so that it may be parallel to the discharging directions of ink droplets from the other ink discharging portions.

Furthermore, if the line head 10 has an ink discharging portion which cannot discharge an ink droplet or can discharge an ink droplet but insufficiently, then since no or little ink droplet is discharged along a pixel column (direction perpendicular to the juxtaposition direction of the ink discharging portions) corresponding to the ink discharging portion, a vertical white stripe appears and deteriorates the print quality. However, where the present embodiment is used, it is possible to use another ink discharging portion positioned in the proximity of the ink discharging portion which cannot discharge an ink droplet sufficiently such that an ink droplet is discharged in place of the ink discharging portion which cannot discharge an ink droplet sufficiently.

Now, the discharging direction deflection means is described more particularly. The discharging direction defection means in the present embodiment includes a current mirror circuit (hereinafter referred to as CM circuit).

Figure 6:
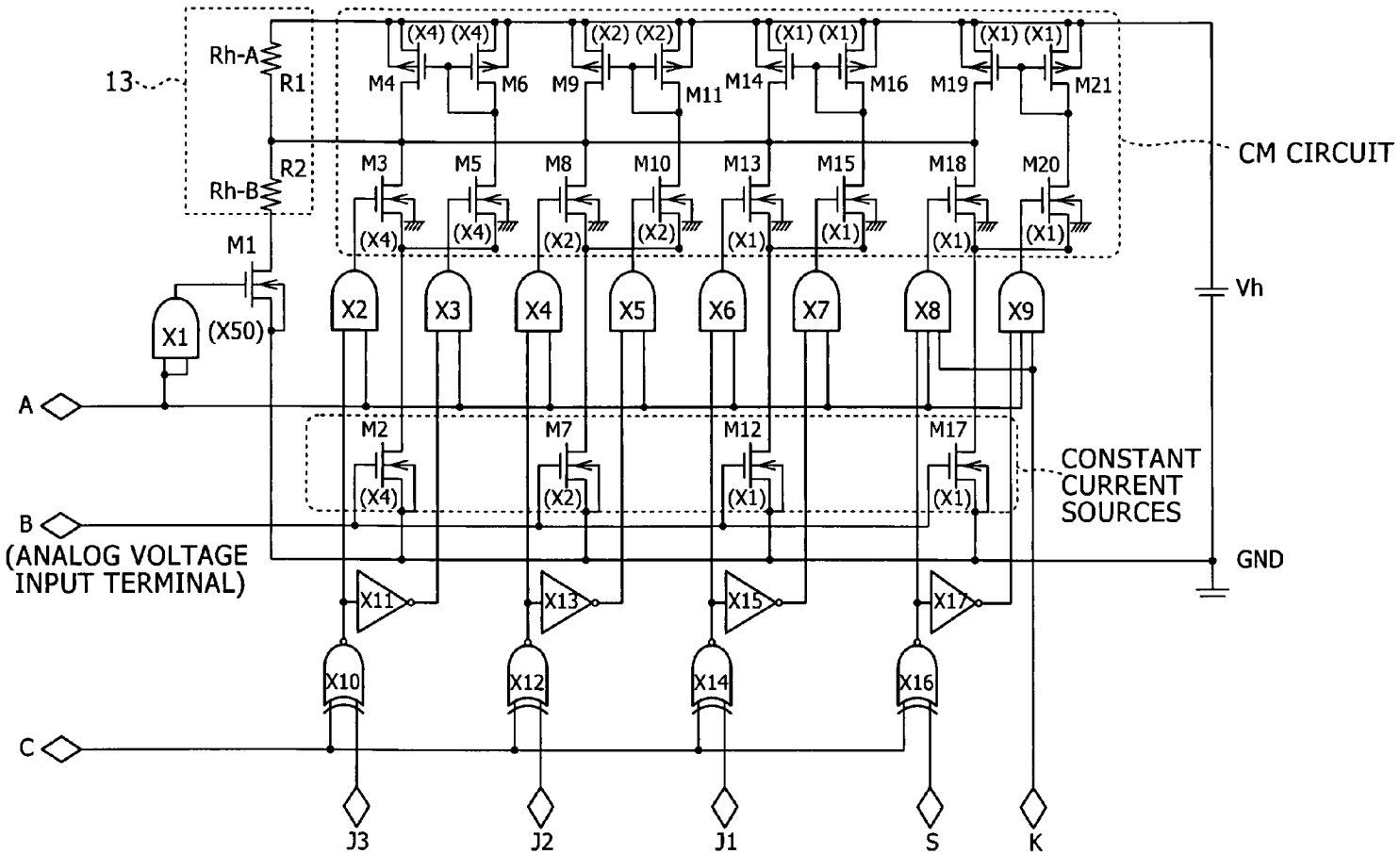
FIG. 6 is a circuit diagram embodying a discharging direction deflection means of the present embodiment.

FIG. 6 is a circuit diagram embodying the discharging direction deflection means of the present embodiment. First, components and a connection state used in the present circuit are described.

Referring to FIG. 6, resistors Rh-A and Rh-B are resistances of the two divisional pieces of the heat generating resistor member 13 and are connected in series. A power supply Vh is a power supply for applying a voltage to the resistors Rh-A and Rh-B.

The circuit shown in FIG. 6 includes transistors M1 to M21, among which the transistors M4, M6, M9, M11, M14, M16, M19 and M21 are PMOS transistors while the other transistors are NMOS transistors. In the third of FIG. 6, a CM circuit is formed, for example, from the transistors M2, M3, M4, M5 and M6, and totaling 4 CM circuits are provided in the circuit.

In the present circuit, the gate of the transistor M6 and the gate of the transistor M4 are connected to each other. Further, the drains of the transistors M4 and M3 are connected to each other, and the drains of the transistors M6 and M5 are connected to each other. This similarly applies also to the other CM circuits.

Furthermore, the drains of the transistors M4, M9, M14 and M19 and the drains of the transistors M3, M8, M13 and M18 each of which forms part of a CM circuit are connected to a midpoint of the resistors Rh-A and Rh-B.

Meanwhile, each of the transistors M2, M7, M12 and M17 serves as a constant current source of a CM circuit, and the drains of them are connected to the sources of the transistors M3, M8, M13 and M18, respectively.

Furthermore, the transistor M1 is connected at the drain thereof in series to the resistor Rh-B such that, when a discharge execution input switch A exhibits a value 1 (ON), the transistor M1 exhibits an ON state to allow electric current to flow through the resistors Rh-A and Rh-B.

Output terminals of AND gates X1 to X9 are connected to the gates of the transistors M1, M3, M5, M8, M10, M13, M15, M18 and M20, respectively. It is to be noted that, although the AND gates X1 to X7 are of the 2-input type, the AND gates X8 and X9 are of the 3-input type. At least one of the input terminals of each of the AND gates X1 to X9 is connected to the discharge execution input switch A.

Furthermore, one of input terminals of XNOR gates X10, X12, X14 and X16 is connected to a deflection direction changeover switch C while the other input terminal is connected to one of deflection control switches J1 to J3 and a discharge angle correction switch S.

The deflection direction changeover switch C is a switch for changing over the ink discharging direction to one of the opposite sides in the juxtaposition direction of the nozzles 18. If the deflection direction changeover switch C is switched to 1 (ON), then one of the inputs of the XNOR gate X10 is switched to 1.

Moreover, each of the deflection control switches J1 to J3 is a switch for determining a deflection amount when deflecting the ink discharging direction. If the input terminal J3 is switched to 1 (ON), then one of the inputs of the XNOR gate X10 is switched to 1.

Further, output terminals of the XNOR gates X10, X12, X14 and X16 are connected respective ones of the input terminals of the AND gates X2, X4, X6 and X8 and also connected to respective ones of the input terminals of the AND gates X3, X5, X7 and X9 through NOT gates X11, X13, X15 and X17, respectively. Further, one of the input terminals of each of the AND gates X8 and X9 is connected to a discharging angle correction switch K.

Furthermore, a deflection amplitude control terminal B is a terminal for determining the amplitude of one step of deflection and is a terminal which determines the current values of the transistors M2, M7, M12 and M17 which serve as the constant current sources of the individual CM circuits. The deflection amplitude control terminal B is connected to the gates of the transistors M2, M7, M12 and M17. If the deflection amplitude control terminal B is set to 0 V, then the electric current of the current sources becomes 0 and no deflection current flows, and consequently, the deflection amplitude can be controlled to zero. If the voltage is gradually raised, then the current value gradually increases, and increasing defection current can be supplied and also the deflection amplitude can be increased.

In other words, an appropriate deflection amplitude can be controlled with the voltage to be applied to the terminal.

Further, the source of the transistor M1 connected to the resistor Rh-B and the sources of the transistors M2, M7, M12 and M17 which serve as the constant current sources of the individual CM circuits are connected to the ground (GND).

In the configuration described above, the numeral (XN), where N=1, 2, 4, or 50, added in a parenthesis to each of the transistors M1 to M21 indicates a parallel connection state of such elements, and for example, (X1) (M12 to M21) indicates that the transistor has a standard device and (X2 ) (M7 to M11) indicates that the transistor has a device equivalent to a parallel connection of two standard devices. In the following description (XN) indicates that the transistor has a device equivalent to a parallel connection of N standard devices.

Consequently, since the transistors M2, M7, M12 and M17 are (X4), (X2), (X1) and (X1), respectively, if a suitable voltage is applied between the gate and the ground of the transistors, then the drain currents of the transistors exhibit a ratio of 4:2:1:1.

Now, operation of the present circuit is described. First, description is given with attention paid only to the CM circuit which includes the transistors M3, M4, M5 and M6.

The discharge execution input switch A exhibits the value 1 (ON) only when ink is to be discharged.

For example, where A=1, B=application of 2.5 V, C=1 and J3=1, since the output of the XNOR gate X10 is 1, this output 1 and A=1 are inputted to the AND gate X2, and the output of the AND gate X2 becomes 1. Consequently, the transistor M3 is turned on.

Further, when the output of the XNOR gate X10 is 1, since the output of the NOT gate X1 is 0, this output 0 and A=1 are inputted to the AND gate X3. Consequently, the output of the AND gate X3 becomes 0, and the transistor M5 is turned off.

Consequently, since the drains of the transistors M4 and M3 are connected to each other and the drains of the transistors M6 and M5 are connected to each other, when the transistor M3 is ON and the transistor M5 is OFF as described above, current flows from the transistor M4 to the transistor M3, but no current flows from the transistor M6 to the transistor MS. Further, from a characteristic of the CM circuit, when no current flows to the transistor M6, no current flows to the transistor M4 either. Further, since 2.5 V is applied to the gate of the transistor M2, corresponding current flows only from the transistor M3 to the transistor M2 from among the transistors M3, M4, M5 and M6 in the case described above.

In this state, since the gate of the transistor M5 is OFF, no current flows to the transistor M6, and no current flows also to the transistor M4 which serves as a mirror to the transistor M6. Although same current Ih should originally flow through the resistor Rh-A and the resistor Rh-B, in the state wherein the gate of the transistor M3 is ON, since current of a current value determined by the transistor M2 is extracted from the midpoint between the resistor Rh-A and the resistor Rh-B through the transistor M3, the current value determined by the transistor M2 is added only to the current flowing to the resistor Rh-A side.

Consequently, $I_{Rh\text{-}A}>I_{Rh\text{-}B}$.

While the foregoing relates to the case wherein C=1, where C=0, that is, where only the input to the deflection direction changeover switch C is made different (the other switches A, B and J3 are set to 1 similarly as in the case described above), the operation is such as follows.

When C=0 and J3=1, the output of the XNOR gate X10 is 0. Consequently, since the inputs to the AND gate X2 become (0, 1 (A=1)), the output of the AND gate X2 is 0. Consequently, the transistor M3 becomes OFF.

Further, when the output of the XNOR gate X10 is 0, since the output of the NOT gate X11 becomes 1, the inputs to the AND gate X3 become (1, 1 (A=1)), and the transistor MS is turned ON.

When the transistor M5 is ON, current flows through the transistor M6. However, from this and the characteristic of the CM circuit, current flows also through the transistor M4.

Consequently, current flows through the resistor Rh-A, transistor M4 and transistor M6 by the power supply Vh. Then, the current flowing through the resistor Rh-A all flows through the resistor Rh-B (since the transistor M3 is OFF, the current flowing out from the resistor Rh-A does not branch to the transistor M3 side). Meanwhile, the current flowing through the transistor M4 all flows into the resistor Rh-B side because the transistor M3 is OFF. Furthermore, the current flowing through the transistor M6 flows to the transistor M5.

From the foregoing, although, when C=1, the current flowing through the resistor Rh-A branches to and flows out to the resistor Rh-B side and the transistor M3 side, when C=0, not only the current flowing through the resistor Rh-A but also the current flowing through the transistor M4 flow into the resistor Rh-B. As a result, the currents flowing through the resistor Rh-A and the resistor Rh-B have a relationship of Rh-A <Rh-B. Then, the ratio exhibits symmetry where C=1 and where C=0.

By making the current amounts to flow through the resistor Rh-A and the resistor Rh-B different from each other in such a manner as described above, a bubble generation time difference on the two pieces of the heat generating resistor member 13 can be provided. Consequently, the discharging direction of an ink droplet can be deflected.

Further, the discharging direction of an ink droplet can be changed over between symmetrical positions in the juxtaposition direction of the nozzles 18 depending upon whether C=1 or C=0.

It is to be noted that, while the foregoing description relates to a case wherein only the defection control switch J3 is ON/OFF, if the defection control switches J2 and J1 are further switched ON/OFF, then the current amounts to be supplied to the resistor Rh-A and the resistor Rh-B can be set more finely.

In particular, while the current to be supplied to the transistors M4, M6 can be controlled by the defection control switch J3, the current to be supplied to the transistors M9 and M11 can be controlled by the defection control switch J2. Furthermore, the current to be supplied to the transistors M14 and M16 can be controlled by the defection control switch J1.

Then, as described hereinabove, drain currents of the ratio of the transistors M4 and M6:transistors M9 and M11:transistors M14 and M16=4:2:1 can be supplied to the transistors as described hereinabove. Consequently, the discharging direction of an ink droplet can be changed to 8 steps of, using the 3 bits of the deflection control switches J1 to J3, (J1, J2, J3)=(0, 0, 0), (0, 0, 1), (0, 1, 0), (0, 1, 1), (1, 0, 0), (1, 0, 1), (1, 1, 0), and (1, 1, 1).

Further, since the current amounts to flow through the transistors M2, M7, M12 and M17 can be changed if the voltages to be applied between the gate and the ground of them, the deflection amount per one step can be changed while the ratio of the drain currents to flow through the transistors remains 4:2:1.

Furthermore, as described hereinabove, the deflection direction can be changed over between symmetrical positions in the juxtaposition direction of the nozzles 18 by means of the deflection direction changeover switch C.

As shown in FIG. 2, in the line head 10 of the present embodiment, a plurality of heads 11 are juxtaposed in the widthwise direction of the print paper and disposed in a zigzag pattern such that adjacent ones of the heads 11 are opposed to each other (each head 11 is disposed in a phase rotated by 180 degrees with respect to an adjacent head 11). In this instance, if common signals are sent from the deflection control switches J1 to J3 to two heads 11 disposed adjacent each other, then the deflection directions of the two adjacent heads 11 become opposite to each other. Therefore, in the present embodiment, the deflection direction changeover switch C is provided so that the deflection directions of the entire one head 11 can be changed over symmetrically.

Consequently, where a plurality of heads 11 are disposed in a zigzag pattern to form a line head, if C is set to C=0 for the heads N, N+2, . . . of the heads 11 which are at even-numbered positions and set to C=1 for the head N−1, N+1, . . . of the heads 11 which are at odd-number positions in FIG. 2, then the deflection directions of the heads 11 of the line head 10 can be set to a fixed direction.

Further, although the discharging angle correction switches S and K are similar to the deflection control switches J1 to J3 in that they are switches for deflecting the discharging direction of ink, they are switches used for correction of the ink discharging angle.

First, the discharging angle correction switch K is a switch for deciding whether or not correction should be performed and is set such that correction is performed where K=1 but is not performed where K=0.

Moreover, the discharging angle correction switch S is a switch for deciding which direction should be corrected, in the juxtaposition direction of the nozzles 18.

For example, when K=0 (when correction is not performed), since one input from among the three inputs of each of the AND gates X8 and X9 becomes 0, both of the outputs of the AND gates X8 and X9 become 0. Consequently, since also the transistors M18 and M20 become OFF, also the transistors M19 and M21 become OFF. As a result, the currents to flow through the resistor Rh-A and the resistor Rh-B do not exhibit any change.

On the other hand, where K=1, for example, if it is assumed that S=0 and C=0, then the output of the XNOR gate X16 becomes 0. Consequently, since (1, 1, 1) are inputted to the AND gate X8, the output of the AND gate X8 becomes 1, and the transistor M18 is turned on. Further, since one of the inputs to the AND gate X9 becomes 0 through the NOT gate X17, the output of the AND gate X9 becomes 0 and the transistor M20 becomes OFF. Consequently, since the transistor M20 is OFF, no current flows to the transistor M21.

Further, from the characteristic of the CM circuit, no current flows to the transistor M19 either. However, since the transistor M18 is ON, current flows out from the midpoint between the resistor Rh-A and the resistor Rh-B into the transistor M18. It is possible to reduce the current amount of the resistor Rh-B compared with the that of the resistor Rh-A. Consequently, the discharging angle of an ink droplet can be corrected thereby to correct the landing position of the ink droplet by a predetermined amount in the juxtaposition direction of the nozzles 18.

It is to be noted that, while, in the embodiment described above, correction by 2 bits formed by the discharging angle correction switches S and K is performed, if the number of switches is increased, then finer correction can be achieved.

Where the switches J1 to J3, S and K described above are used to deflect the discharging direction of an ink droplet, the current (deflection current Idef) can be represented by $$Idef=J3\times4\times Is+J2\times2\times Is+J1\times Is+S\times K\times Is=(4\times J3+2\times J2+J1+S\times K)\times Is \quad \text{(Expression 1)}$$

In the Expression 1, +1 or −1 is given to J1, J2 and J3, and +1 or −1 is given to S while +1 or 0 is given to K.

As can be recognized from the Expression 1, the deflection current can be set to 8 stages by settings of J1, J2 and J3, and correction can be performed by S and K independently of the settings of J1 to J3.

Further, since the deflection current can be set to four stages in positive value and four stages in negative value, the deflection direction of an ink droplet can be set to the opposite directions in the juxtaposition direction of the nozzles 18. For example, in FIG. 4, it is possible to deflect the deflection direction of an ink droplet by θ to the left side with respect to the vertical direction (Z1 direction in FIG. 4) and also to deflect the deflection direction of an ink droplet by θ to the right side (Z2 direction in FIG. 4). Further, the value of θ, that is, the deflection amount, can be set arbitrarily.

Further, by controlling the application voltage value to the deflection amplitude control terminal B, the discharging deflection angle of an ink droplet can be changed (the application voltage value can be controlled digitally, for example, using a D/A converter).

Accordingly, since the transistors M2, M7 and M12 have the ratio of (X4), (X2 ) and (X1) as described hereinabove, the drain currents to them exhibit the ratio of 4:2:1. Consequently, the current amount can be changed to eight stages within a range corresponding to the voltage value applied to the deflection amplitude control terminal B. As a result, the discharging deflection angle of an ink droplet can be adjusted to eight stages. It is to be noted that, if the number of transistors is further increased, then the current amount can naturally be changed more finely.

Figure 7:
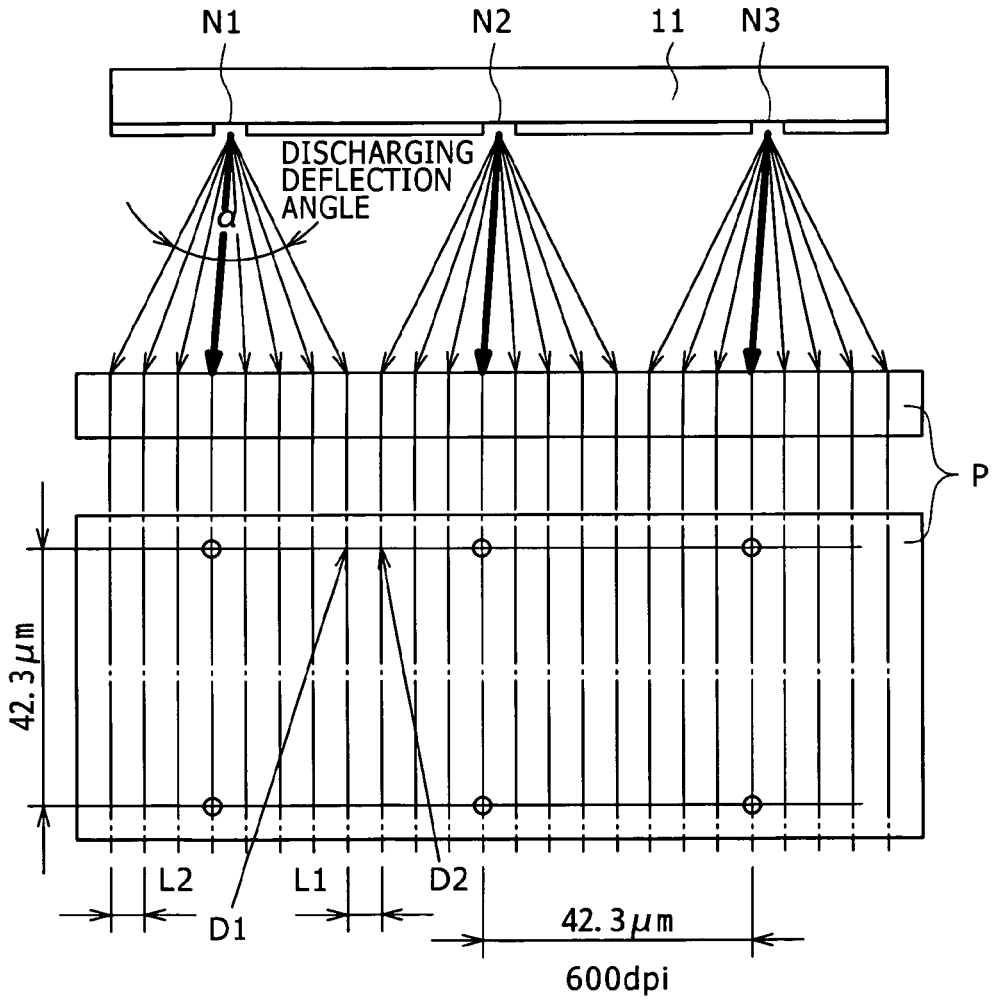
FIG. 7 is a view illustrating a state wherein ink droplets are discharged in a deflected state from ink discharging portions of the head in an example wherein the resolution is 600 dpi.
Figure 10:
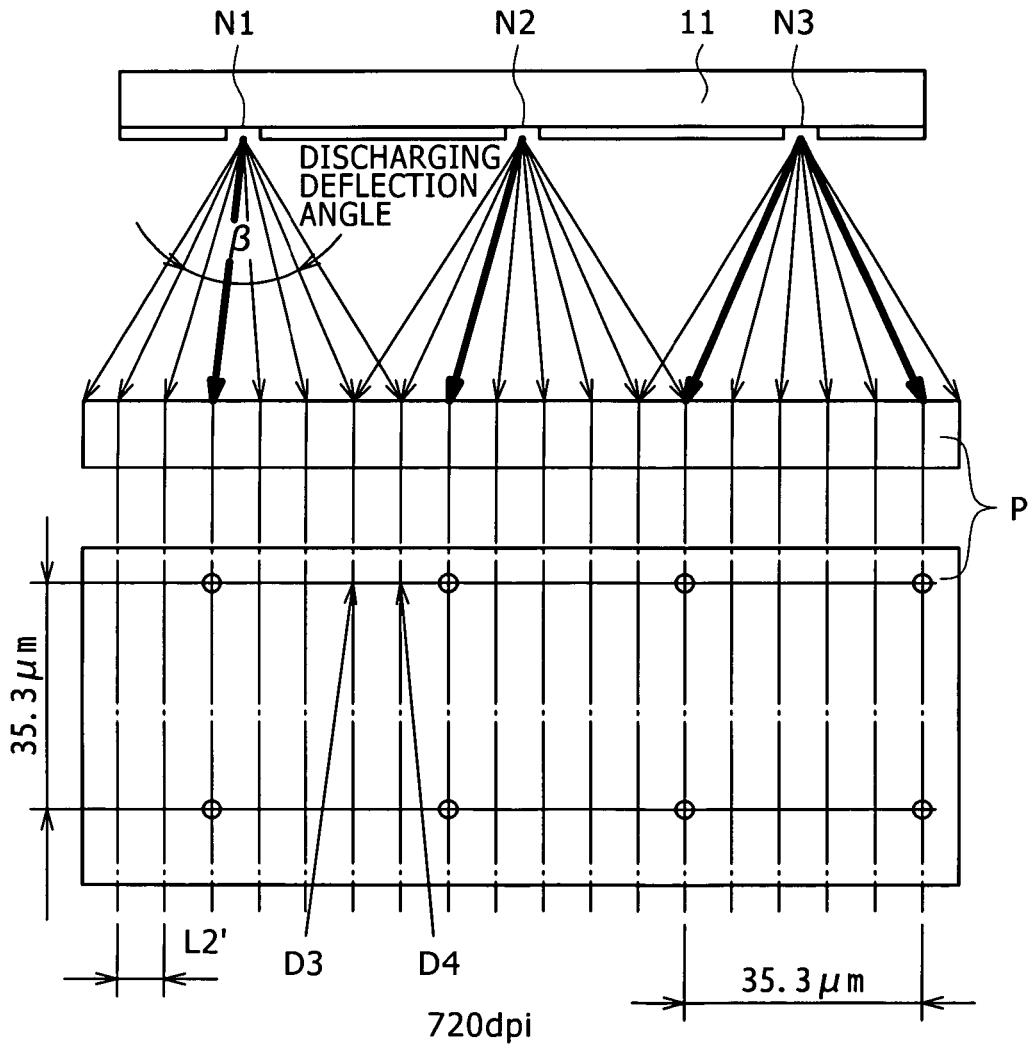
FIG. 10 is a view illustrating a state wherein ink droplets are discharged in a deflected state from the ink discharging portions of the head in a still further example wherein the resolution is 720 dpi.
Figure 11A:
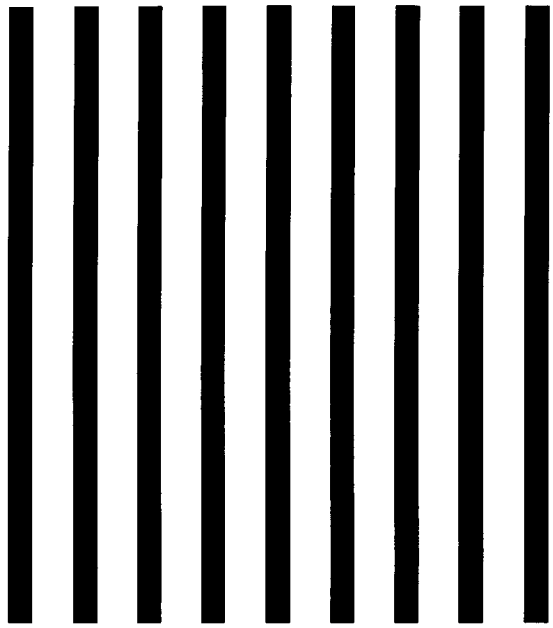
FIG. 11A is a view showing white and black lines of an image of 600 dpi in an enlarged scale and FIG. 11B is a view showing an example wherein the image of FIG. 11A is printed after it is converted into an image of 720 dpi.
Figure 11B:
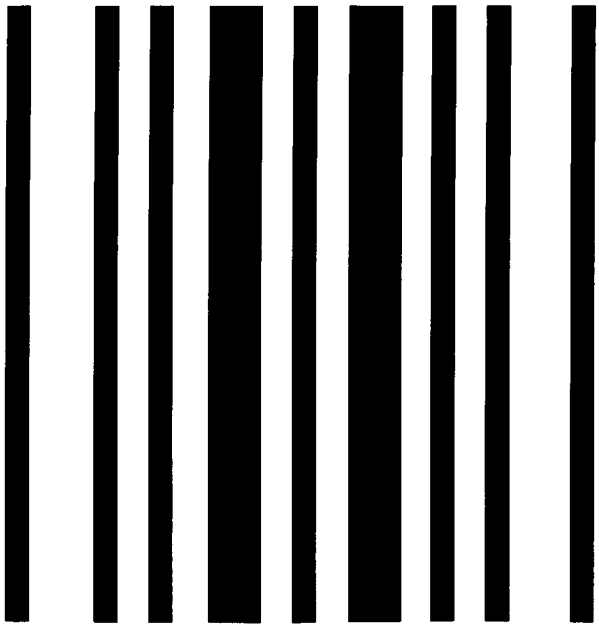

Also it is possible, for example, as shown in FIG. 7, to set the discharging deflection angle (in this example, maximum deflection amount) to α in response to the voltage value applied to the deflection amplitude control terminal B, or it is possible to set the discharging deflection angle to β (≠α) as seen in FIG. 10.

Now, several examples where the configuration described above is used to vary the resolution in printing are described.

FIG. 7 is a view illustrating a state wherein an ink droplet is discharged in a deflected state from each of the ink discharging portions N1 to N3 of a head 11. It is assumed that, in FIG. 7, the discharging deflection direction of an ink droplet from each of the ink discharging portion N1 and so forth can be changed over to eight different directions using 3 bits of the deflection control switches J1 to J3 as described hereinabove. Further, it is assumed that the discharging deflection angle (maximum deflection amount) is set to α in response to the voltage value applied to the deflection amplitude control terminal B.

Here, in FIG. 7, the discharging deflection angle α is set in the following manner in two adjacent ones of the ink discharging portions, for example, in the ink discharging portions N1 and N2. In particular, the discharging deflection angle α is set such that both of a landing point distance L1 between a landing position D1 of an ink droplet when the ink droplet is discharged to the most right side from the left side ink discharging portion N1 and another position D2 of an ink droplet when the ink droplet is discharged to the most left side from the right side ink discharging portion N2 and a landing point distance L2 between adjacent ones of ink droplets when the ink droplets are discharged in the eight directions from the one ink discharging portion N1 or the like may be 5.3 μm and equal to each other.

Furthermore, the distance between the ink discharging portion N1 and so forth (nozzles 18) is set to 42.3 μm so as to implement 600 dpi.

At this time, where an ink droplet is discharged (in FIG. 7, the discharging direction of the link droplet is indicated by a thick line) along the fourth deflection direction as counted from the left side in the dischargeable eight deflection directions in all of the ink discharging portion N1 and so forth in FIG. 7, the landing point distance between adjacent ones of the ink droplets discharged from the ink discharging portion N1 and so forth is equal to the juxtaposition distance of the ink discharging portion N1 and so forth and is 42.3 μm so as to implement 600 dpi.

Figure 8:
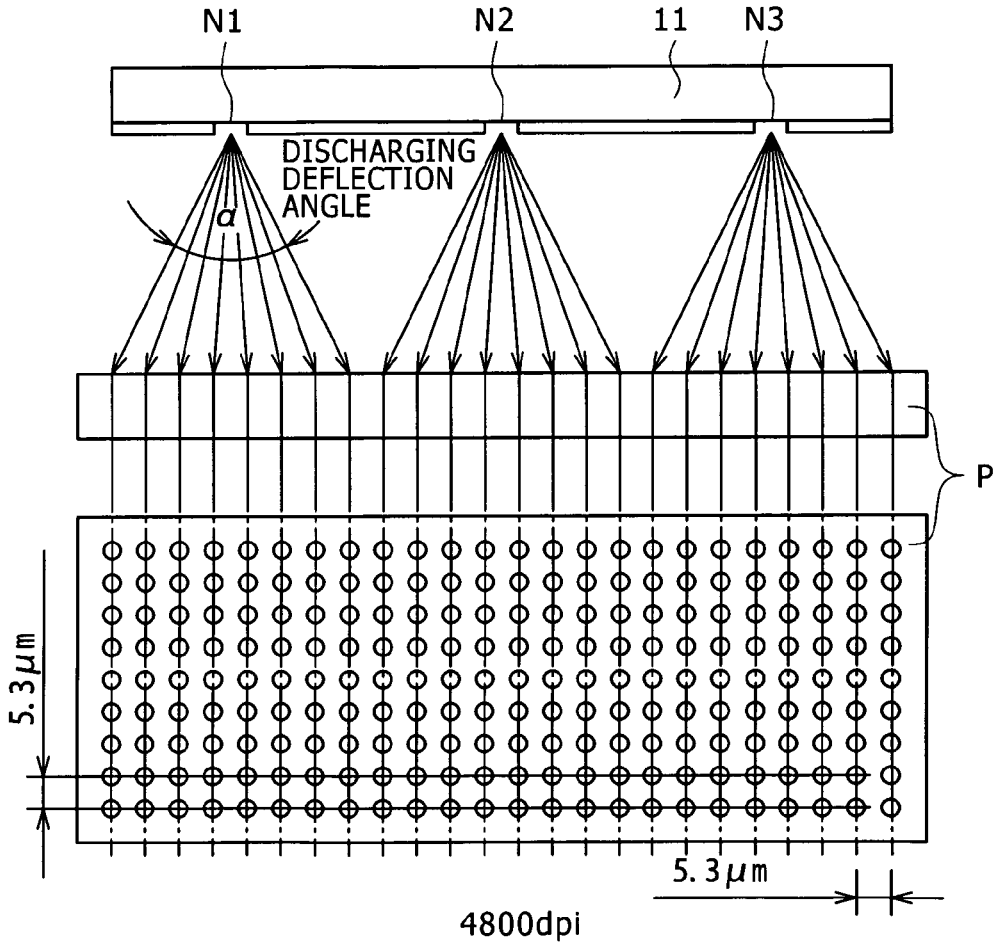
FIG. 8 is a view illustrating a state wherein ink droplets are discharged in a deflected state from the ink discharging portions of the head in another example wherein the resolution is 4,800 dpi.

In contrast, where ink is discharged in all of the dischargeable eight deflection directions from all of the ink discharging portion N1 and so forth as seen in FIG. 8 (in this instance, each of the ink discharging portion N1 and so forth discharges an ink droplet eight times on one line (line in the juxtaposition direction of the ink discharging portion N1 and so forth), the landing position distance between the ink droplets is 5.3 μm to implement 4,800 dpi.

Figure 9:
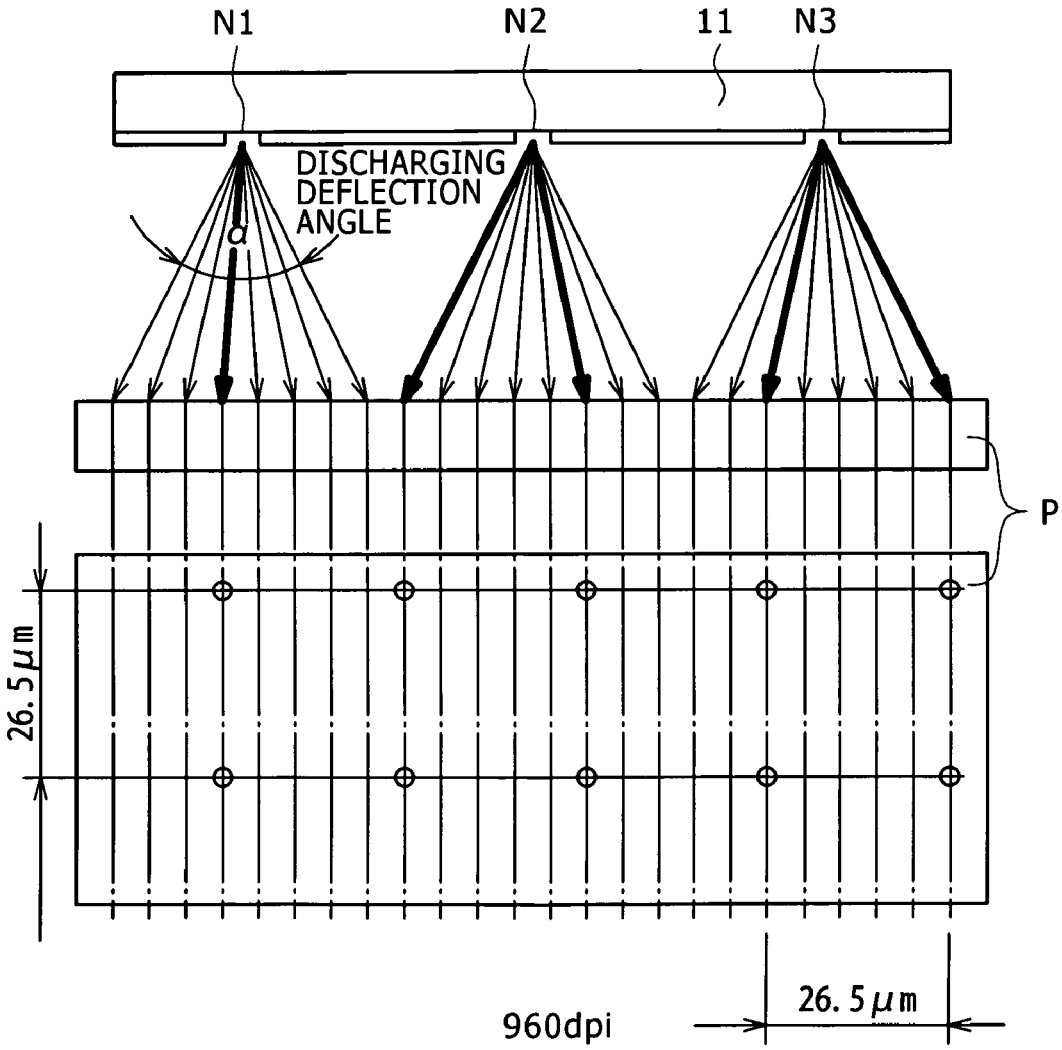
FIG. 9 is a view illustrating a state wherein ink droplets are discharged in a deflected state from the ink discharging portions of the head in a further example wherein the resolution is 960 dpi.

Meanwhile, it is assumed that, in FIG. 9, the left side ink discharging portion N1 discharges an ink droplet in the fourth deflection direction as counted from the left side and the central ink discharging portion N2 discharges ink droplets in the first and sixth directions as counted from the left side while the right side ink discharging portion N3 discharges ink droplets in the third and eighth directions as counted from the left side. In other words, while the ink discharging portion N1 discharges an ink droplet once on one line, the ink discharging portions N2 and N3 discharge an ink droplet twice on one line.

Where the ink discharging portions N1, N2 and N3 are controlled in this manner, the landing point distance between the ink droplets is equal to five times 5.3 μm, that is, 26.5 μm to implement 960 dpi.

Furthermore, FIG. 10 shows an example wherein the discharging deflection angle is changed from α to β. As described hereinabove, the discharging deflection angle can be changed from α to β in response to the voltage value applied to the deflection amplitude control terminal B.

Here, it is assumed that, where the discharging deflection angle is β, the landing point distance L2' (corresponding to L2 in FIG. 7) between ink droplets when the ink droplets are discharged in the eight directions from one ink discharging portion N1 or the like is set to 7.06 μm.

Further, the discharging deflection angle β is set such that, in two adjacent ones of the ink discharging portions, for example, in the ink discharging portions N1 and N2, the landing position D3 of an ink droplet when the ink droplet is discharged in the seventh direction as counted from the left from the left side ink discharging portion N1 and the landing position D3 of an ink droplet when the ink droplet is discharged to the most left side from the right side ink discharging portion N2 substantially coincide with each other. Similarly, the discharging deflection angle β is set such that the landing position D4 of an ink droplet when the ink droplet is discharged to the most right side from the left side ink discharging portion N1 and the landing position D4 of an ink droplet when the ink droplet is discharged in the second direction as counted from the left from the right side ink discharging portion N2 substantially coincide with each other.

It is assumed that, in FIG. 10, the left side ink discharging portion N1 discharges an ink droplet in the fourth deflection direction as counted from the left side and the central ink discharging portion N2 discharges an ink droplet in the third direction as counted from the left side while the right side ink discharging portion N3 discharges ink droplets in the second and seventh directions as counted from the left side. In other words, while the ink discharging portions N1 and N2 discharge an ink droplet once on one line, the ink discharging portion N3 discharges an ink droplet twice on one line.

Where the ink discharging portions N1, N2 and N3 are controlled in this manner, the landing point distance between the ink droplets is equal to five times 7.06 μm, that is, 35.3 μm to implement 720 dpi.

As described above, where the ink discharging portion N1 and so forth can deflect and discharge an ink droplet in eight directions, a plurality of resolutions can be used for printing by changing the discharging direction from the ink discharging portion N1 and so forth.

Furthermore, further different resolutions can be used for printing by changing the discharging deflection angles.

While the original printing resolution of the printer of the present embodiment is 600 dpi as seen in FIG. 7, where the discharges of ink droplets from the ink discharging portion N1 and so forth are thinned out, printing can be performed also with 300 dpi or 150 dpi. Furthermore, by printing with a density twice or four times that of FIG. 7, printing with 1,200 dpi or 2,400 dpi can be implemented in addition to printing with 4,800 dpi illustrated in FIG. 8.

Furthermore, such printing with 960 dpi as seen in FIG. 9 can be implemented, and also printing with 480 dpi or 320 dpi can be implemented by thinning out the landing point distances of ink droplets in this instance to ½ or ⅓.

Furthermore, by thinning out the landing point distances of ink droplets illustrated in FIG. 8 to ⅓, printing with 1,600 dpi can be implemented, and by thinning out the landing point distances further to one half, printing with 800 dpi can be implemented.

Further, in addition to printing with 720 dpi illustrated in FIG. 10, also printing with 360 dpi can be implemented by thinning out the landing point distances in this instance to one half.

In the present embodiment, when print data are inputted to the printer, a printing resolution is determined in response to the inputted print data. For example, where the resolution of the print data is 300 dpi, although it is possible to set the printing resolution equal to the resolution of the print data, also it is possible to change the printing resolution. When the printing resolution is to be changed, although it is possible to change the printing resolution by an operation of a user on the computer or printer side, also it is possible to set a printing resolution corresponding to the print data in advance on the printer side and automatically perform such change of the printing resolution. The printing resolution may be changed to a printing resolution by which the resolution deterioration is little, for example, based on information of the print size and information of the resolution in the inputted print data or based on information of the print size and information of the number of pixels.

Further, where the resolution is to be changed, when the resolution of the print data is M dpi, if the printing resolution after the change is set to M×n (n is a natural number) or M×1/n, then deterioration of the resolution can be suppressed low favorably.

Furthermore, when a printing resolution is to be determined, it may be determined such that all of the print data have an equal printing resolution, or it may be determined otherwise such that part of the print data has a first printing resolution and the other part of the print data has a second printing resolution different from the first printing resolution. For example, where the print data include both of a photograph and a document in a mixed state, the printing resolution may be determined such that it is set to 600 dpi for the photograph while it is set to 300 dpi for the document.

After a printing resolution is determined, the discharging deflection angle, the ink discharging portion N1 and so forth which should discharge an ink droplet is selected based on the printing resolution. For example, a data table wherein, for all printing resolutions with which the printer can print, discharging deflection angles corresponding to them and the ink discharging portion N1 and so forth to be selected are set in advance may be provided such that the data table is referred to to select a discharging deflection angle and the ink discharging portion N1 and so forth which should discharge an ink droplet is selected. It is to be noted that, where the resolution is equal to or higher than 600 dpi, all of the ink discharging portion N1 and so forth are selected in the printing region, but where the resolution is lower than 600 dpi, since the ink discharging portion N1 and so forth in which discharges of ink droplets are thinned out (discharging of an ink droplet is not performed) exist, the ink discharging portion N1 and so forth are selected.

Then, after a discharging deflection angle is determined, the deflection amplitude is controlled by controlling the voltage value to be applied to the deflection amplitude control terminal B so that the determined discharging deflection angle may be obtained.

Further, upon printing, a discharge execution signal with which the discharging direction of an ink droplet can be specified is transmitted to each of the selected ink discharging portion N1 and so forth. For example, the discharge execution signal represents the eight discharging directions of the ink discharging portion N1 and so forth in codes of eight digits in order from the left side and represents the case wherein an ink droplet should be discharged by "1" but represents the case wherein an ink droplet should not be discharged by "0".

In this instance, for example, in the example of FIG. 9, a discharge execution signal of "00010000" is transmitted to the ink discharging portion N1, a discharge execution signal of "10000100" is transmitted to the ink discharging portion N2, and another discharge execution signal of "00100001" is transmitted to the ink discharging portion N3.

When the discharge execution signal is received, the ink discharging portion N1 and so forth control discharges of an ink droplet in accordance with the received signal. For example, if the ink discharging portion N2 receives the discharge execution signal of "10000100" described hereinabove, then the ink discharging portion N2 controls so that an ink droplet is discharged in the first and sixth directions as counted from the left side on the line.

It is to be noted that it is necessary for the printer side to change also the printing timing of the print paper P in the feeding direction in response to the printing resolution. For example, where the printing resolution of 600 dpi is used for printing, it is necessary to perform printing such that the landing point distance between ink droplets is 42.3 μm in the juxtaposition direction of the ink discharging portion N1 and so forth. However, also in the feeding direction of the print paper P (direction perpendicular to the juxtaposition direction of the ink discharging portion N1 and so forth), it is necessary for the landing point distance between ink droplets to be 42.3 μm (refer to FIG. 7).

While an embodiment of the present invention is described above, the present invention is not limited to the embodiment described above but can be modified in various manners, for example, as described below.

(1) While the present embodiment is configured such that the discharging deflection angle can be changed to α or β, the printing resolution may be changed otherwise by changing only the discharging direction of an ink droplet to be discharged from the ink discharging portion N1 and so forth while the discharging deflection angle is fixed. However, where the discharging deflection angle can be changed, then the number of kinds of the printing resolution which the printing apparatus has can be made greater.

(2) While, in the present embodiment, the current values to flow through the two divisional pieces of the heat generating resistor member 13 are made different from each other to provide a time difference between the periods of time (bubble generation times) required for an ink droplet to be boiled on the two divisional pieces of the heat generating resistor member 13, the method of providing such time difference is not limited to this, but two divisional pieces of a heat generating resistor member 13 having an equal resistance value may be provided in a juxtaposed relationship to each other such that current is supplied at different timings to the two divisional pieces of the heat generating resistor member 13. For example, if an independent switch is provided for each of the two pieces of the heat generating resistor member 13 and the switches are switched on at different timings, then a time difference can be provided between the times required for an ink bubble to be generated on the two pieces of the heat generating resistor member 13. Further, to change the current values to flow to the pieces of the heat generating resistor member 13 and to provide a time difference between the times within which current is supplied may be used in-combination.

(3) Further, while the present embodiment indicates an example wherein two divisional pieces of a heat generating resistor member 13 are provided in one ink liquid chamber 12, the number of such divisional pieces is not limited to this, but it is possible to use three or more pieces of a heat generating resistor member 13 (energy generation means) juxtaposed in one ink liquid chamber 12. Also it is possible to form a heat generating resistance member from one substrate which is not in a divisional form and connect a conductor (electrode), for example, to a folded back portion of a substantially meandering portion (substantially U shape or the like) in a shape in plan of the heat generating resistance member. Furthermore, a principal portion of the heat generating resistance member for generating energy for discharging an ink droplet is divided into at least two portions such that a difference is provided in generation of energy between at least one of the divisional principal portions and at least another one of the divisional principal portions. Accordingly, the discharging direction of an ink droplet may be deflected by the difference.

(4) While, in the present embodiment, the heat generating resistor member 13 is taken as an example of the energy generation means of the thermal type, a heat generating element formed from an element different from a resistor may be used. Further, it is not limited to a heat generating element, but an energy generation element of any other type may be used. For example, an energy generation means of the electrostatic discharging type or the piezoelectric type may be used.

The energy generation means of the electrostatic discharging type includes, for example, a diaphragm and two electrodes provided on the lower side of the diaphragm with an air layer interposed therebetween. A voltage is applied between the two electrodes to distort the diaphragm to the lower side, whereafter the voltage is changed to 0 V to release the electrostatic force. At this time, the resilient force of the diaphragm when it restores its original state is utilized to discharge an ink droplet.

In this instance, in order to provide a difference in generation of energy between individual energy generation means, for example, either a time difference may be provided between the two energy generation means when the diaphragm is permitted to restore its original state (the voltage is set to 0 V so that the electrostatic force is released) or the voltage value to be applied may have values different from each other for the two energy generation means.

Meanwhile, the energy generation means of the piezoelectric type includes, for example, a laminated member of a piezoelectric element having electrodes on the opposite faces thereof and a diaphragm. If a voltage is applied between the electrodes on the opposite faces of the piezoelectric element, then a bending moment is generated on the diaphragm by a piezoelectric effect and distorts and deforms the diaphragm. The deformation is utilized to discharge an ink droplet.

Also in this instance, in order to provide a difference in generation of energy between the different energy generation means, either a time difference may be provided between the two piezoelectric elements when a voltage is applied between the electrodes on the opposite faces of the piezoelectric elements or the voltage value to be applied may have values different from each other for the two piezoelectric elements.

INDUSTRIAL APPLICABILITY

According to the present invention, an image can be printed with an optimum resolution with comparatively little deterioration in response to a resolution of an original image using a head wherein the discharging direction of an ink droplet from each ink discharging portion can be deflected to a plurality of directions.

The invention claimed is:

1. A printing apparatus comprising:

a plurality of heads disposed in a staggering overlapping relationship in a width direction of a printing medium, each one of the plurality of heads including a plurality of ink discharging portions provided in a juxtaposed linear relationship thereon, a pitch between ink discharging portions located at ends of adjacent heads is identical to a space between ink discharging portions of each of the plurality of heads, each one of the plurality of ink discharging portions configured to deflect an ink droplet to be discharged therefrom in a plurality of directions coplanar with the line connecting the ink discharging portions and to set a discharging deflection angle which is a maximum deflection amount of the ink droplet to be discharged from said ink discharging portions to a plurality of angles, wherein, the head is configured to determine a printing resolution, in response to print data from between or among a plurality of printing resolutions which are determined based on a distance separating said ink discharging portions, the discharging deflection angle of the ink droplet to be discharged from said ink discharging portions and a plurality of directions in which the ink droplet can be discharged from said ink discharging portions, the head is configured to select ink discharging portions from which an ink droplet can be discharged and the discharging deflection angle of the discharged ink droplet based on the determined printing resolution, and to determine the discharging direction of one or two or more ink droplets from the selected ink discharging portions, and the head is configured to determine the discharging direction of the ink droplet for each of the selected ink discharging portions to execute printing with the determined printing resolution.

2. A printing apparatus according to claim 1, wherein printing resolutions of said printing apparatus corresponding to print data are determined in advance, and a printing resolution is determined in response to the print data based on the determination.

3. A printing apparatus according to claim 1, wherein, where the resolution of the print data is M, if said printing apparatus has M×n (n being a natural number) or M×1/n as a printing resolution with which said printing apparatus can print, then the printing resolution is determined to M×n or M×1/n.

4. A printing apparatus according to claim 1, wherein, where the print data includes information of a resolution or a number of pixels together with information of a print size, the printing resolution is determined based on the information of the print size and the resolution or the information of the print size and the number of pixels.

5. A printing apparatus according to claim 1, wherein, in response to the print data, part of the print data is determined to a first printing resolution and the other part of the print data is determined to a second printing resolution different from the first printing resolution.

6. A printing method in which a plurality of heads disposed in an staggered overlapping relationship in a width direction of a printing medium, a pitch between ink discharging portions located at ends of adjacent heads is identical to a space between ink discharging portions of each of the plurality of heads, each one of the plurality of heads including a plurality of ink discharging portions provided in a juxtaposed linear relationship thereon is used, the method comprising the steps of:

deflecting a discharging direction of an ink droplet to be discharged from each of said ink discharging portions to a plurality of directions coplanar with the line connecting said ink discharging portions and the discharging deflection angle which is a maximum deflection amount of the ink droplet to be discharged from said ink discharging portions can be set to a plurality of angles;

determining a printing resolution in response to print data from between or among a plurality of printing resolutions which are determined based on a distance separating said ink discharging portions, the discharging deflection angle of the ink droplet to be discharged from said ink discharging portions and a plurality of directions in which an ink droplet can be discharged from said ink discharging portions;

selecting ink discharging portions from which the ink droplet can be discharged and the discharging deflection angle of the ink droplet based on the determined printing resolution and determining the discharging direction of one or two or more ink droplets from the selected ink discharging portions on one line is determined; and determining the discharging direction of an ink droplet for each of the selected ink discharging portions to execute printing with the printing resolution determined in response to the print data from between or among the plurality of printing resolutions.

* * * * *